United States Patent [19]

Mitchell et al.

[11] Patent Number: 4,798,035

[45] Date of Patent: Jan. 17, 1989

[54] FLOOR-TO-CEILING WALL SYSTEM

[75] Inventors: Terry L. Mitchell, Jenison; Lawrence J. Spoolstra, Byron Center, both of Mich.

[73] Assignee: Architectural Wall Systems, Inc., Grand Rapids, Mich.

[21] Appl. No.: 918,540

[22] Filed: Oct. 14, 1986

Related U.S. Application Data

[63] Continuation-in-part of Ser. No. 869,439, Jun. 2, 1986, Pat. No. 4,709,517.

[51] Int. Cl.[4] ..... E04B 1/00

[52] U.S. Cl. ..... 52/281; 52/287; 52/242

[58] Field of Search ..... 52/273, 278, 287, 288, 52/242, 238.1, 36, 281

[56] References Cited

U.S. PATENT DOCUMENTS

| | | | |
|---|---|---|---|
| 1,193,575 | 8/1916 | McFarland . | |
| 1,694,690 | 12/1928 | Reinhold . | |
| 2,055,442 | 9/1936 | Jones . | |
| 2,325,766 | 8/1943 | Gisondi . | |
| 2,766,855 | 10/1956 | Johnson . | |
| 2,768,410 | 10/1956 | Woodard . | |
| 2,796,158 | 6/1957 | Miles . | |
| 2,968,374 | 1/1961 | Bohnsack . | |
| 3,093,218 | 6/1963 | Peterson . | |
| 3,180,457 | 4/1965 | Bohnsack . | |
| 3,191,727 | 6/1965 | Schmeltz . | |
| 3,205,630 | 9/1965 | Felix . | |
| 3,339,954 | 9/1967 | Alvden . | |
| 3,358,411 | 12/1967 | Birum, Jr. . | |
| 3,393,484 | 7/1968 | Dannington | 52/242 |
| 3,395,504 | 8/1968 | Zwickert . | |
| 3,451,183 | 6/1969 | Lespagnol . | |
| 3,482,706 | 12/1969 | Stewart . | |
| 3,508,364 | 4/1970 | Thompson . | |
| 3,619,960 | 11/1971 | Thompson . | |
| 3,621,635 | 11/1971 | De Lange . | |
| 3,631,647 | 1/1972 | Merkin . | |
| 3,638,387 | 2/1972 | Lickliter . | |
| 3,680,271 | 8/1972 | Satchell . | |
| 3,685,227 | 8/1972 | Grisard | 52/242 |
| 3,724,150 | 4/1973 | Hudnall . | |
| 3,733,756 | 5/1973 | Butler . | |
| 3,745,708 | 7/1973 | Gulistan . | |
| 3,755,979 | 9/1973 | Pantazi . | |
| 3,830,027 | 8/1974 | Paisley . | |
| 3,837,128 | 9/1974 | O'Brien . | |
| 3,845,601 | 11/1974 | Kostecky . | |
| 3,948,011 | 4/1976 | Price . | |
| 3,952,462 | 4/1976 | Heise . | |
| 3,983,670 | 10/1976 | Lightfoot . | |
| 3,990,205 | 11/1976 | Davis . | |
| 4,034,535 | 7/1977 | Dustmann . | |
| 4,037,380 | 7/1977 | Pollock . | |
| 4,041,667 | 8/1977 | Lindner . | |
| 4,080,766 | 3/1978 | Jastrabek | 52/242 |
| 4,103,463 | 8/1978 | Dixon . | |
| 4,120,124 | 10/1978 | Temple . | |
| 4,229,918 | 10/1980 | Delcroix | 52/242 |
| 4,245,442 | 1/1981 | Durham . | |
| 4,287,698 | 9/1981 | Baus . | |
| 4,356,672 | 11/1982 | Beckman . | |
| 4,458,462 | 7/1984 | Schold . | |

FOREIGN PATENT DOCUMENTS

| | | | |
|---|---|---|---|
| 695368 | 6/1964 | Canada | 52/238 |
| 2036962 | 9/1962 | Fed. Rep. of Germany . | |
| 1467796 | 1/1967 | France | 52/242 |
| 2238020 | 2/1975 | France . | |
| 103546 | 3/1964 | Norway | 52/242 |
| 430126 | 8/1967 | Sweden | 52/238.1 |
| 2070100 | 1/1970 | United Kingdom . | |

*Primary Examiner*—Henry E. Raduazo

*Attorney, Agent, or Firm*—Price, Heneveld, Cooper, DeWitt & Litton

[57] ABSTRACT

The specification discloses a partition system in which any gap between an end partition and an existing wall is concealed by a combination rigid channel and flexible cover. The rigid channel embraces and provides firm anchorage for the end of the partition and a flexible cover on each side of said channel conceals the rigid channel and any gap between the partition and a fixed wall from view. Yet, the flexible cover can be deflected to provide access to hanger bracket slots or the like which might be located at the end of the partition.

27 Claims, 6 Drawing Sheets

FLOOR-TO-CEILING WALL SYSTEM

CROSS REFERENCE TO RELATED APPLICATION

This is a continuation-in-part of U.S. patent application Ser. No. 06/869,439, filed June 2, 1986, now U.S. Pat. No. 4,709,517 12/01/87 and entitled FLOOR TO CEILING WALL SYSTEM.

BACKGROUND OF THE INVENTION

The present invention relates to floor-to-ceiling partition systems. One problem encountered with such systems is obtaining proper alignment of a partition against an existing vertical wall which may not be plumb relative to the floor upon which the partition system is mounted. A related problem involves dealing with short spaces or gaps between an existing wall and the end of a panel where the dimensions required for a particular area to be enclosed do not precisely accommodate the standard lengths of partitions in a partitions system. In such cases, some manufacturers simply make special, relatively short panels to fit in such spaces.

One attempt to deal with such problems is disclosed in United Kingdom Pat. No. 580,623. In that patent, a two-piece channel shaped member is provided for securing to the wall. The larger generally "L" shaped channel portion is first secured to the wall leaving the other side of the channel open. This allows an assembler to access to an adjusting bolt which is used to adjust the spacing between the wall and the end of a panel. The channel is then closed off with the smaller member, which is snapped into place and is locked in place by means of interlocking lips.

One problem with that system is that it is made of metal and once both sides of the channel are in place, one can no longer access the space between the panel and the wall. Such access might be especially desirable if a slotted stud system were used and one wanted access to the slots in the end stud. Further even when the interior is accessible, i.e., during the initial erection phase, it is accessible from only one side of the panel.

Another problem presented by the British patent is that the metal channel and panel dimensional tolerances must be kept tight. Otherwise, gaps between the channel and wall panel will result in rattling and will allow noise to pass around the end of the wall panel.

One could obviate the problems created by the U.K. system by making the wall channel pieces out of flexible plastic so the channel walls could be bent. However, the channel member would then not be strong enough to properly hold the partition panels in vertical alignment.

In spite of the fact that U.K. Patent 580,623 has been a matter of public record since 1946, these problems have not heretofore been solved.

SUMMARY OF THE INVENTION

The present invention is a partition system in which variations in the distance between an existing wall and the end of a partition are accommodated by means of a combination rigid channel and flexible cover assembly. The sidewalls of the rigid channel embrace an end portion of the closest partition to hold it in position. A pair of spaced, flexible covers are secured to the rigid channel through cooperating securing means, on either side of the rigid channel. The flexible covers include cover flaps which are longer than the rigid sidewalls of the channel and which extend out over and embrace the opposite sides of the end partition.

These and other objects, advantages and features of the present invention will be more fully understood and appreciated by reference to the appended specification and drawings.

DETAILED DESCRIPTION OF THE PREFERRED EMBODIMENT

Figure 10:
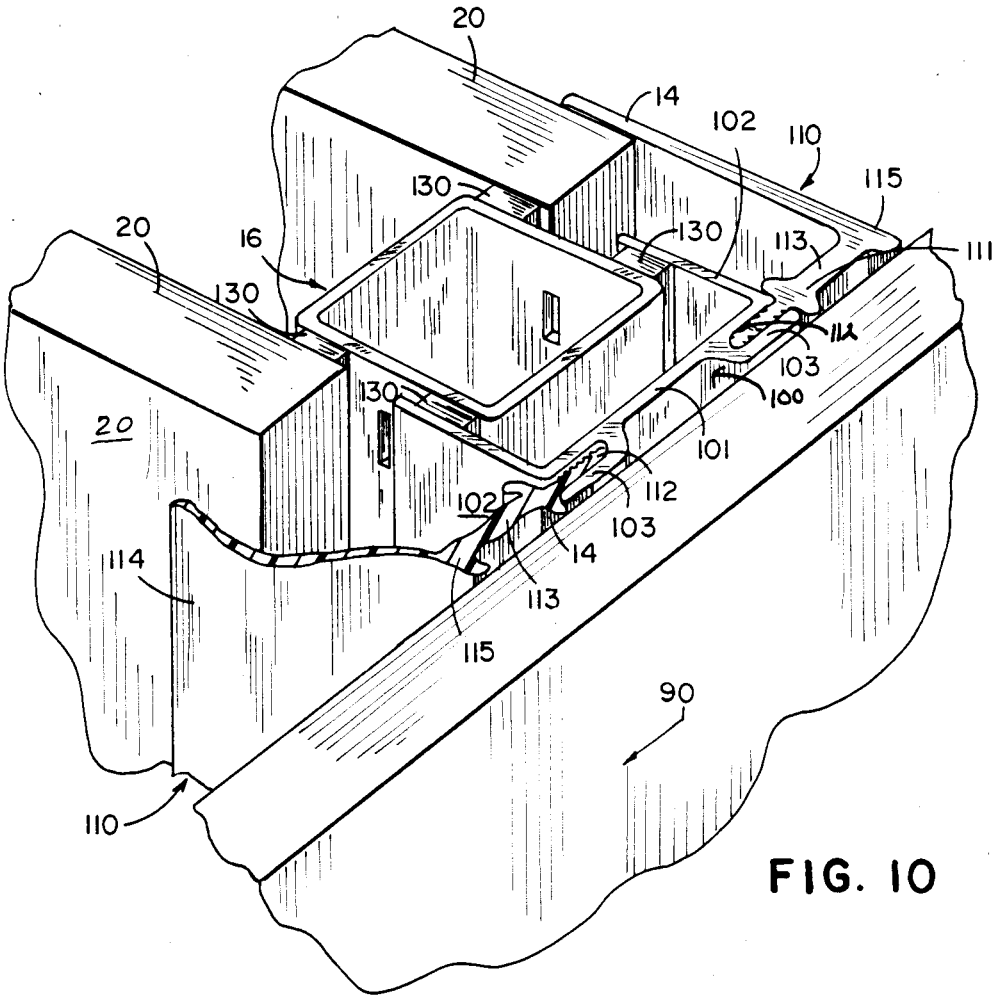
FIG. 10 is a fragmentary, perspective view of a vertical stud adjacent a structural wall, shown with a wall abutment assembly extending between the structural wall and the vertical stud, taken in the region of arrow X in FIG. 4.

In the preferred embodiment, the wall system 10 includes a ceiling channel 12 and a floor leveler channel or assembly 14. A series of telescoping vertical studs 16 extend between ceiling bracket 12 and floor leveler assembly 14. A set of generally horizontal stringers 18 span between adjacent vertical studs 16, while wall panels 20 are hung from stringers 18. Any gap between the end vertical stud 16 of a partition and an existing wall 90 is accommodated by a rigid end channel 100 which embraces end stud 16 and flexible covers 110 which are operably connected to rigid channel 100 and which extend out and embrace the opposite surface panels 20 (FIG. 10).

During assembly of wall system 10, one entire wall is levelled simultaneously by the adjustment of floor leveler assembly 14. A first vertical stud 16 is supported between the ceiling channel and the floor leveler assembly, and this first stud 16 is vertically aligned and secured in place. Thereafter the next adjacent stud 16 is positioned between ceiling channel 12 and floor leveler assembly 14, and a set of stringers 18 are secured between the first vertical stud 16 and the next successive stud 16. The securing of stringers 18 aligns the adjacent studs 16, and the remaining successive vertical studs 16 are aligned by the sequential placement of stringers 18 between successive vertical studs 16.

Figure 1:
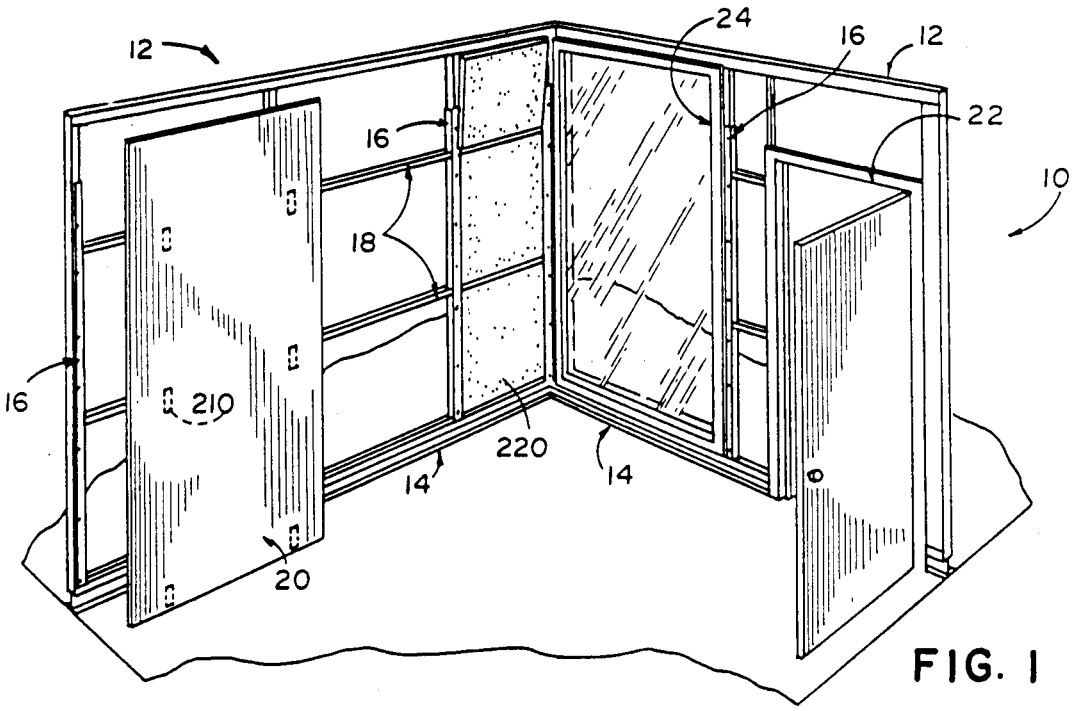
FIG. 1 is a perspective, exploded view of the wall system embodying the invention, showing the system in partially assembled condition.
Figure 2:
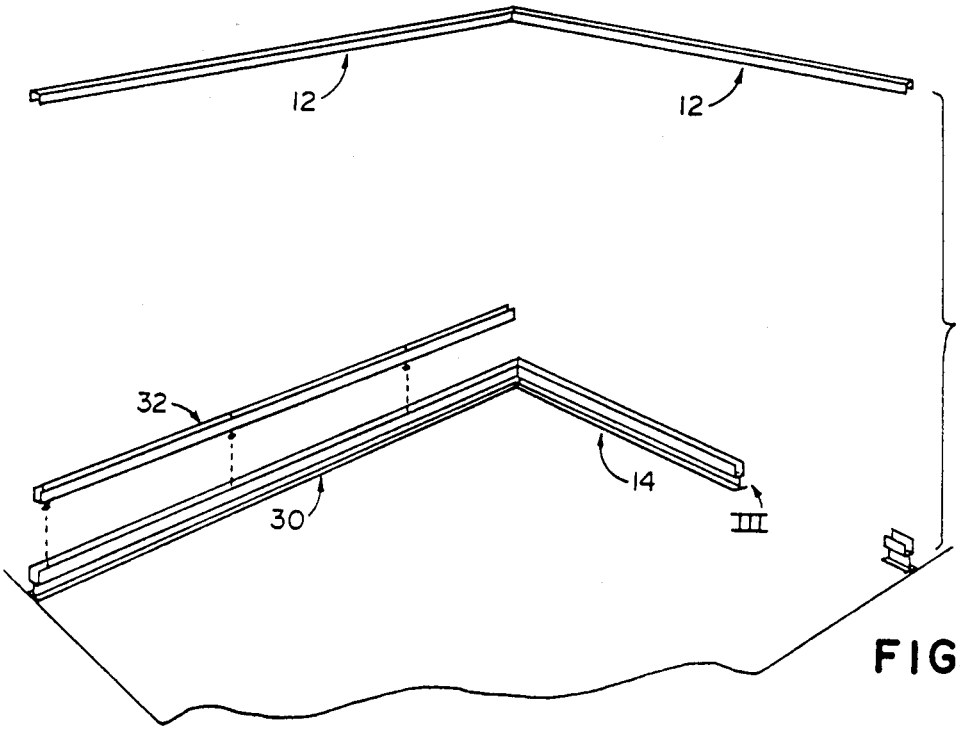
FIG. 2 is a perspective, exploded view of the ceiling channel and floor leveler assembly used in the system shown in FIG. 1.

Initially, as shown in FIG. 2 ceiling channel 12 is secured along the structural ceiling and floor leveler assembly 14 is positioned on the floor surface generally aligned beneath ceiling channel 12. As shown in FIG. 2, ceiling channel 12 and floor leveler assembly 14 are positioned to partition off a corner area of a work space and therefore two sets of ceiling channel 12 and floor leveler assemblies 14 extend at right angles between two corner structural walls. Although a single set of elements for wall system 10 are described, wall system 10 may be used to provide a single wall, a four walled enclosure or any other combination required for a given work environment.

Floor leveler assembly 14 includes a floor track or runner 30 (FIG. 3) and a leveler channel 32. The base of floor runner 30 has a generally "I" beam construction that spaces a raised upper channel 34 above the floor surface. Upper channel 34 is a generally rectangular, upwardly opening "U" shaped channel in which leveler channel 32 is received. Floor runner 30, including its base portion and upper channel 34, is extruded as a single piece. Leveler channel 32 is an elongated, upwardly opening "U" shaped bracket that closely nests in upper channel 34. A series of adjustment bolts 36 are spaced along leveler channel 32 and extend between leveler channel 32 and upper channel 34. Each adjustment bolt 36 has a slotted upper end 38 that permits a screwdriver to be inserted for the adjustment of bolt 36. Adjustment bolts 36 are threaded through a Tinnerman nut 39 and the undersurface of leveler bracket 32, and the heads 40 of bolts 36 rotatably abut upper channel 34 so that the adjustment of bolts 36 raises or lowers leveler channel 32 relative to floor runner 30.

Figure 3:
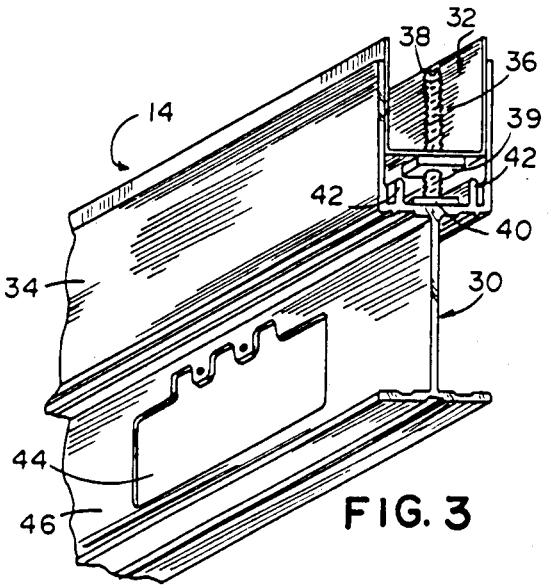
FIG. 3 is a fragmentary, perspective view of the floor leveler assembly of FIG. 2, taken in the region of arrow III in FIG. 2.

Floor leveler assembly 14 is horizontally levelled by setting to a predetermined heighten the adjustment bolt 36 at one end of leveler channel 32 and then adjusting the bolt 36 at the opposite end of leveler channel 32. The remaining intermediate adjustment bolts 36 are lowered until bolt heads 40 contact upper channel 34 in order to provide additional support for leveler channel 32 along its length. As shown in FIG. 3, protruding from the lower surface of upper channel 34 are two seating flanges 42 that provide a lower stop for leveler bracket 32. Bolt heads 40 are seated between seating flanges 42. Also shown in FIG. 3, upper channel 34 is raised above the floor surface in order to provide wire ways running along the base of floor runner 30. Molding covers are snapped into floor runner 30 beneath upper channel 34 to close and mask the wire ways. Electrical outlet mounting apertures 44 (FIG. 3) are knocked out from lower webbing 46 in order to permit the placement of electrical outlets boxes or other circuitry at selected locations along floor leveler assembly 14. Upper channel 34 is raised above the floor surface so that electrical conduit and the like may extend along floor runner 30 without interfering with the levelling mechanism or other various elements that are mounted on leveler assembly 14.

Figure 5:
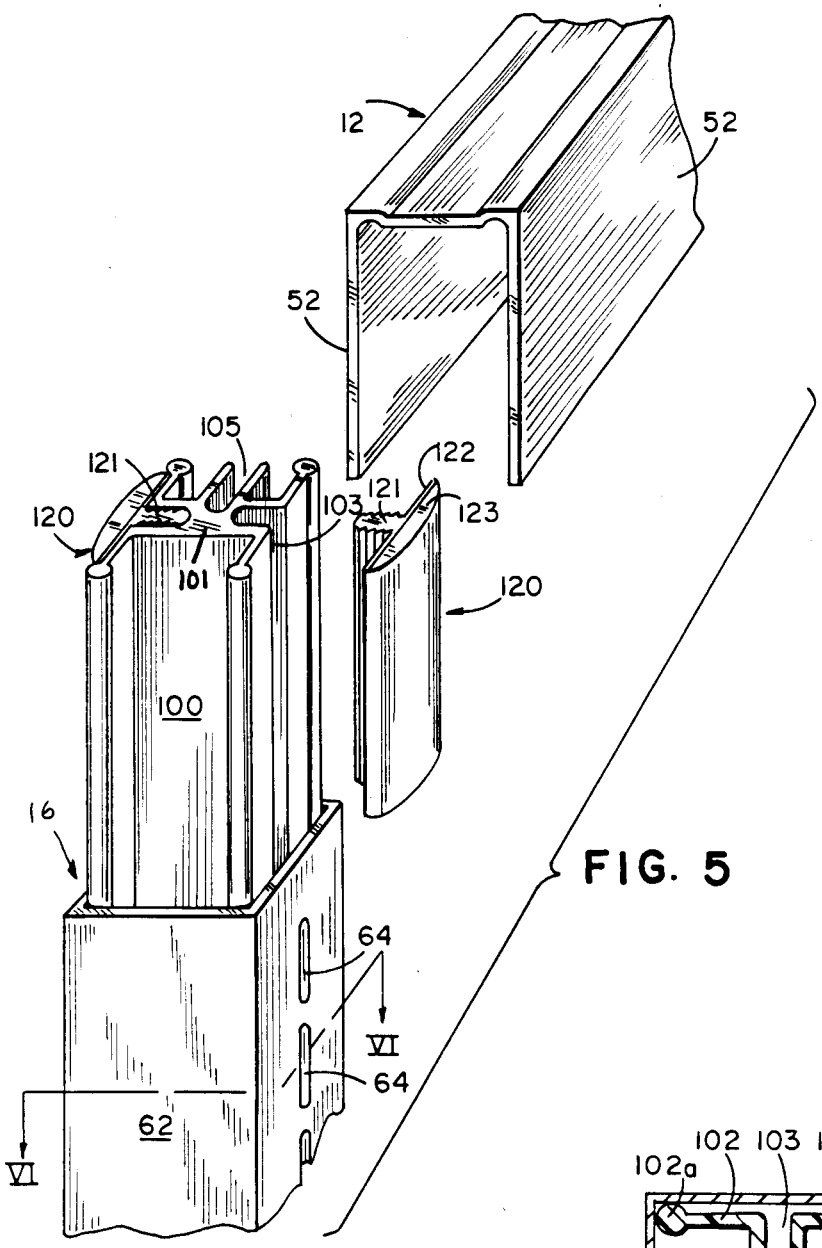
FIG. 5 is a fragmentary, perspective view of the upper end of one of the vertical studs being assembled onto the ceiling channel, taken in the region of arrow V in FIG. 4.

As shown in FIG. 5, ceiling channel 12 is a rectangular, inverted "U" shaped bracket that is secured to the ceiling by screws 50 or other suitable conventional fasteners. Ceiling channel 12 includes two depending sidewalls 52 that are spaced to slidably receive the upper ends 100 of telescoping studs 16.

Figure 4:
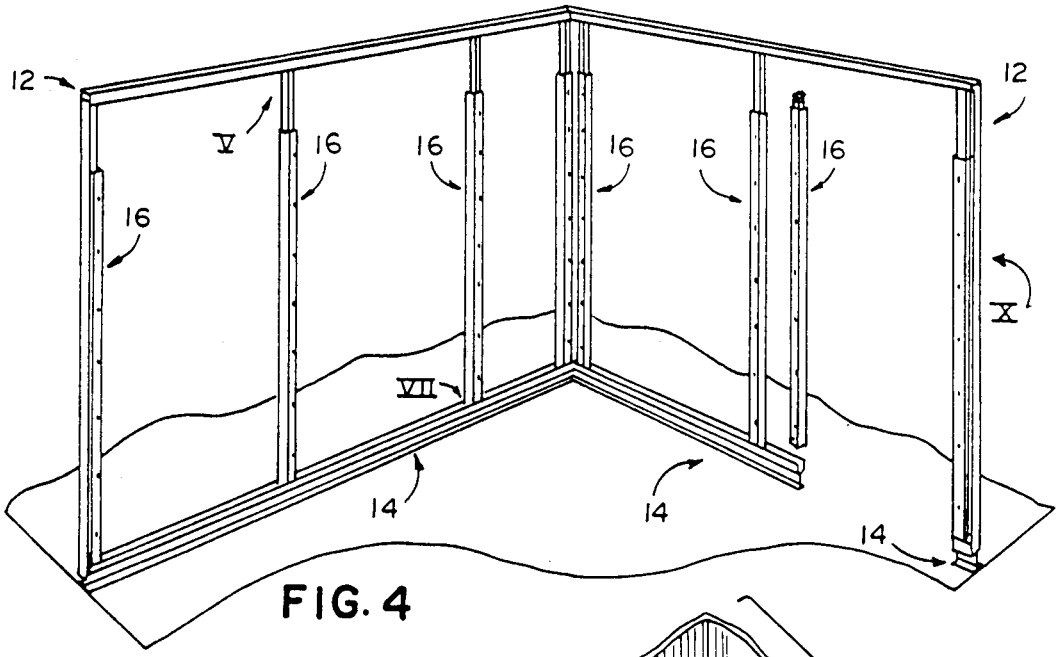
FIG. 4 is a perspective view of the vertical studs using the system of FIG. 1, shown being assembled onto the ceiling channel and floor leveler assembly.

As shown in FIG. 4, a series of telescoping studs 16 are roughly positioned between ceiling channel 12 and floor leveler assembly 14. As shown in FIG. 5, each telescoping stud 16 includes a rectangular upper post 100 that is telescopingly received in a lower base section 62. Vertically spaced along base section 62 are a series of accessory hanging slots 64 that are used to mount wall hanging accessories as described more fully below. A circular or rectangular post of compressible foam material is slid down into each telescoping stud 16 to extend along at least lower base section 62 in order to block light and reduce sound from passing through slots 64. The foam material compresses when hooks are inserted into slots 64.

Figure 6:
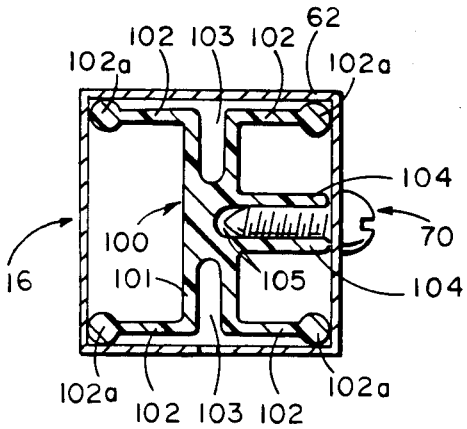
FIG. 6 is a cross-sectional view taken along plane VI—VI of FIG. 5.

Upper post 100 of each telescoping stud 16 is preferably extruded of aluminum and includes a wide central web 101 extending from one side thereof to the other and legs 102 extending laterally from each side, at each end, of web 101 (FIGS. 5 and 6). The length of web 101 and of legs 102 define the perimeter of upper stud member 100, and are dimensioned such that upper member 100 telescopes reasonably snugly within lower member 62 of stud 16.

Extending along the length of each end of web 101 and for some distance inwardly into web 101 are a pair of opposed slots 103. Slots 103 serve as means for mounting resiliently compressible friction members 120 on upper stud member 100.

Projecting laterally from the center of web 101 are a pair of spaced vertical walls 104 which define a third slot or channel 105. Slot 105 serves to receive screw 70 which is used to secure upper stud member 100 against movement with respect to lower stud member 62 (FIG. 6).

Each leg 102 of telescoping upper member 100 terminates in an enlarged bead 102a. Beads 102a provide some tolerance latitude, in that if upper member 100 is extruded so as to be slightly oversized, some of the surface material will scrape off beads 102a in engaging the interior of lower stud member 62 so that a slidable relationship can still be achieved. The exterior surfaces of legs 102 themselves, and the ends of web 101 itself, do not directly engage the interior surfaces of lower stud member 62.

Threaded fastening member 70 comprises a self-tapping screw of approximately three-quarters of an inch. It is received in a suitable aperture near the top of lower stud member 62 and its threads dig into the interior surfaces of lateral walls 104 to positively secure upper stud member 100 against movement with respect to lower stud member 62 when such secureness is desired.

Resiliently compressible members 120 are preferably short lengths of conventional trim material usually referred to in the art as "T-molding." T-molding is typically extruded of a polymeric material such as polyvinyl chloride.

Each resiliently compressible member 120 includes a rearwardly projecting prong flange 121, which extends rearwardly from approximately the center of a support flange 122. Prong flange 121 includes a plurality of retainer barbs on either side thereof. Integrally extruded with support flange 122 is a slightly rounded facing member 123. These components are usually co-extruded in such a manner that prong 121 and flange 122 are of a somewhat more rigid polymeric material while facing portion 123 is of a more compressible polymeric material. It is typical to use polyvinyl chloride of two different durometers in order to achieve this variance.

Facing member 123 is preferably somewhat rounded in configuration as shown in FIG. 5 to facilitate insertion into ceiling channel 12. Compressible members 120 are positioned at the top of the upper stud member 100 by inserting prong flanges 121 into slots 103 (FIG. 5). Slots 103 are configured so as to snugly receive prong 121 and are sufficiently deep that prong 121 can be fully inserted into slot 103. The plurality of barbs projecting laterally from each side thereof are slanted to facilitate insertion of prong 121 but hinder its removal from slots 103.

With both resiliently compressible members 120 in position on opposite sides of upper stud member 100, upper stud member 100 can be forced into position between the sidewalls 52 of ceiling channel 12. The rounded surface of compressible members 120 facilitates this insertion through a combined upward and sideward movement. Once in position within ceiling channel 12, the rounded surface portions 123 of resiliently compressible members 120 engage the inside surfaces of walls 52 in a friction manner. Sliding movement can be achieved within ceiling channel 12, but the friction fit is sufficiently snug that upper member 100 will be held in position within ceiling channel 12. Once in proper position, upper stud member 100 is locked in position by threading self-tapping screw 70 into slot 105, between walls 104.

Figure 7:
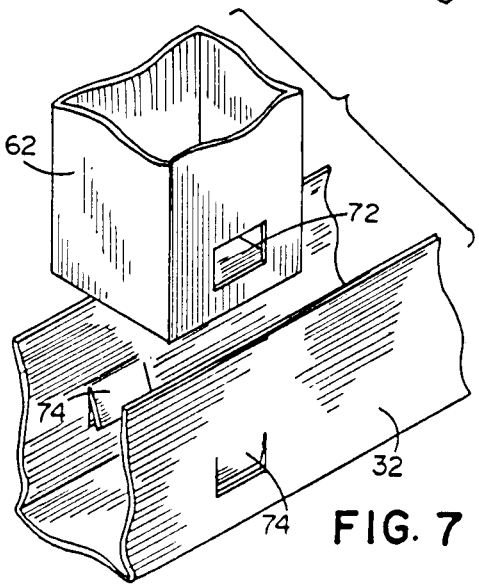
FIG. 7 is a fragmentary, perspective view of the lower end of a vertical stud being assembled onto the floor leveler assembly, taken in the region of arrow VII in FIG. 4.

As shown in FIG. 7, the lower end of base section 62 is slidably seated in leveler channel 32. The lower end of base section 62 includes a set of rectangular apertures 72 that mate wtih indented tabs or tangs 74 on the sides of leveler channel 32. During assembly base section 62 is snapped into place over tab 74 in order to roughly position telescoping studs 16 at predetermined intervals along floor leveler assembly 14. As shown in FIG. 4, telescoping studs 16 are each first seated in leveler channel 32 over one positioned tab 74, and upper member 100 is then raised until friction members 120 are seated frictionally within ceiling channel 12. The first telescoping stud 16 in the series of studs 16 is vertically aligned. The first stud 16 may be accurately aligned using a level, plumb bob, or the like, or in some installations visual alignment of the first telescoping stud 16 may be sufficient. Once aligned, screw 70 is tightened in order to fix the length of telescoping stud 16. The fixed length of telescoping stud 16 resists the lateral movement of upper post along ceiling channel 12, as does the frictional resistance provided by friction elements 120. Leveler channel 32 may also be provided without tabs 74, so that telescoping studs 16 may be seated anywhere along the length of channel 32. Friction between the sides of channel 32 and studs 16 maintain studs 16 in position.

Figure 8:
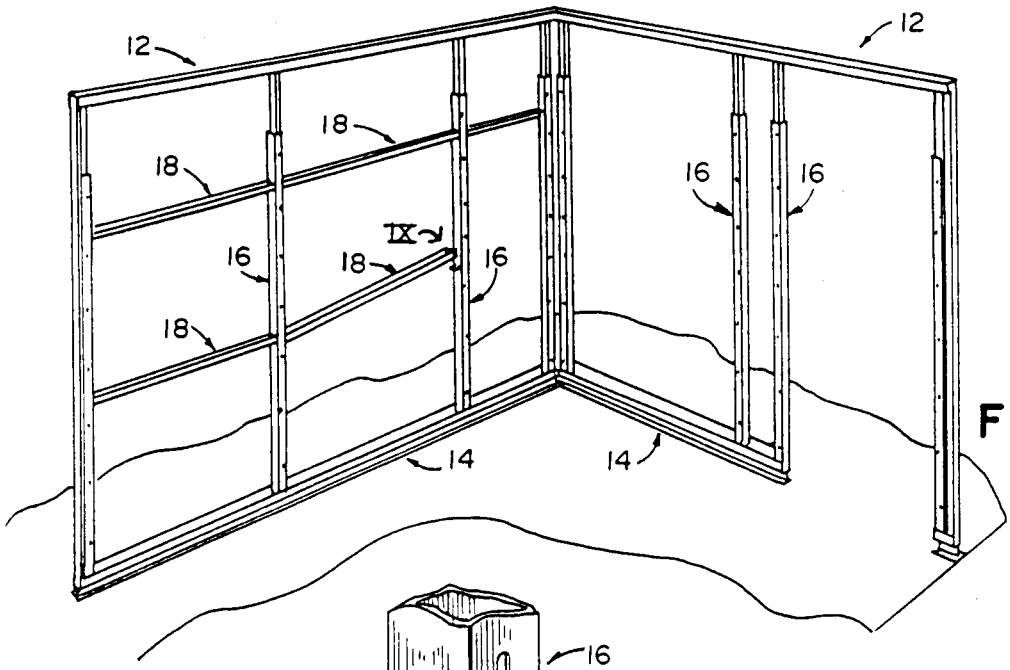
FIG. 8 is a perspective view of horizontal stringers used in the system of FIG. 1 shown being assembled onto the vertical studs.

As shown in FIG. 8, horizontal stringers 18 are secured between adjacent telescoping studs 16. Starting from the initial telescoping stud 16 that had been vertically aligned, a set of stringers 18 are secured between the aligned studs 16 and the next successive stud 16. The placement of stringers 18 automatically aligns the next successive telescoping stud 16. This sequence is followed down along the series of telescoping studs 16, so that the positioning of stringers 18 sequentially aligns each telescoping stud 16 automatically without requiring the assembler to align the individual studs 16 by conventional methods.

Figure 9:
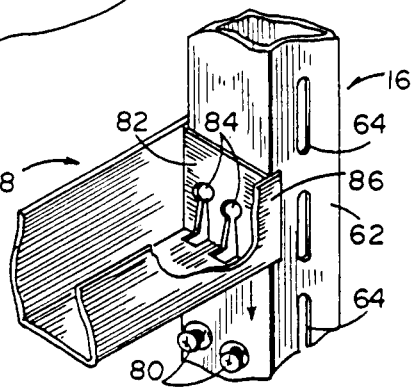
FIG. 9 is a fragmentary, perspective view of the end of a horizontal stringer being assembled onto a vertical stud, taken in the region of arrow IX in FIG. 8.

As shown in FIG. 9, stringers 18 are secured to lower section 62 of studs 16. Each lower section 62 includes two laterally spaced shoulder screws 80 set at predetermined heights along the length of lower section 62. Stringer 18 has a generally rectangular, upwardly opening U-shaped cross section, with a mounting tab 82 bent up at each end. Mounting tab 82 includes two keyhole slots 84 that widen and open out through the bottom of stringer 18. Keyhole slots 84 are spaced and configured to receive shoulder screws 80 with snap-setting action and thereby rigidly join adjacent studs 16. The sidewalls of stringers 18 extend past mounting tab 82 to form two projecting alignment tabs 86 on both ends of each stringer 18. Alignment tabs 86 project slightly past the sides of telescoping studs 16 and slidably abut lower section 62 in order to form a shallow pocket in which lower section 62 is snugly received. Alignment tabs 86 provide additional rigidity to the joint formed between stringer 18 and studs 16. As shown in FIG. 8, a set of two stringers 18 are secured between each adjacent pair of studs 16 in order to square up the next successive telescoping stud 16.

Figure 12:
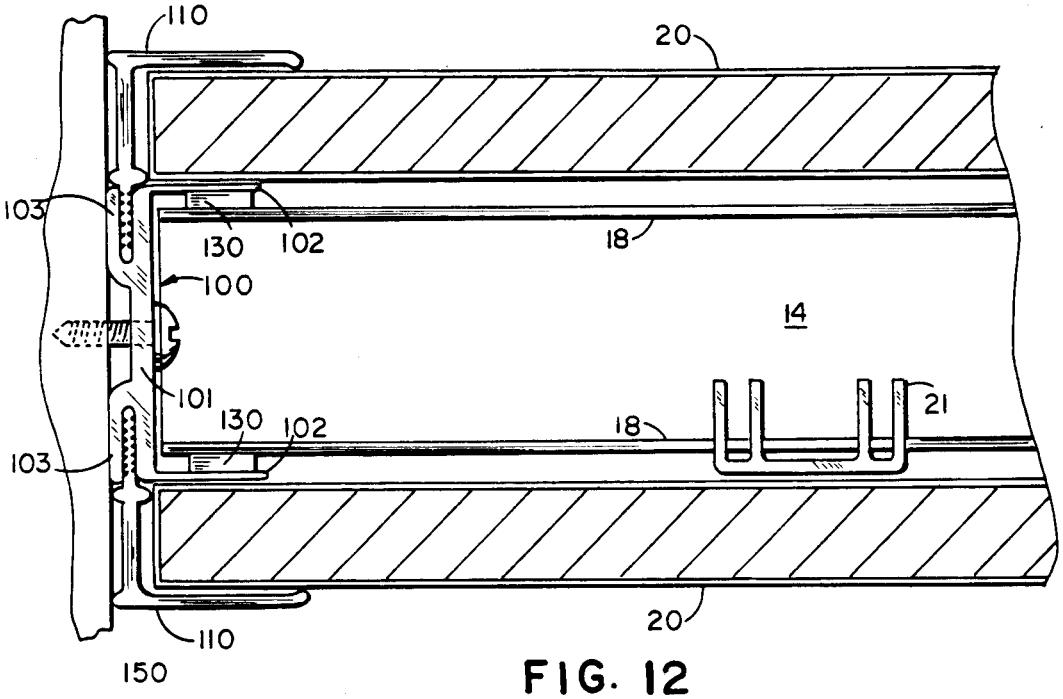
FIG. 12 is a top cross-sectional view of the wall system illustrating another way to use the wall abutment assembly of this invention.
Figure 11:
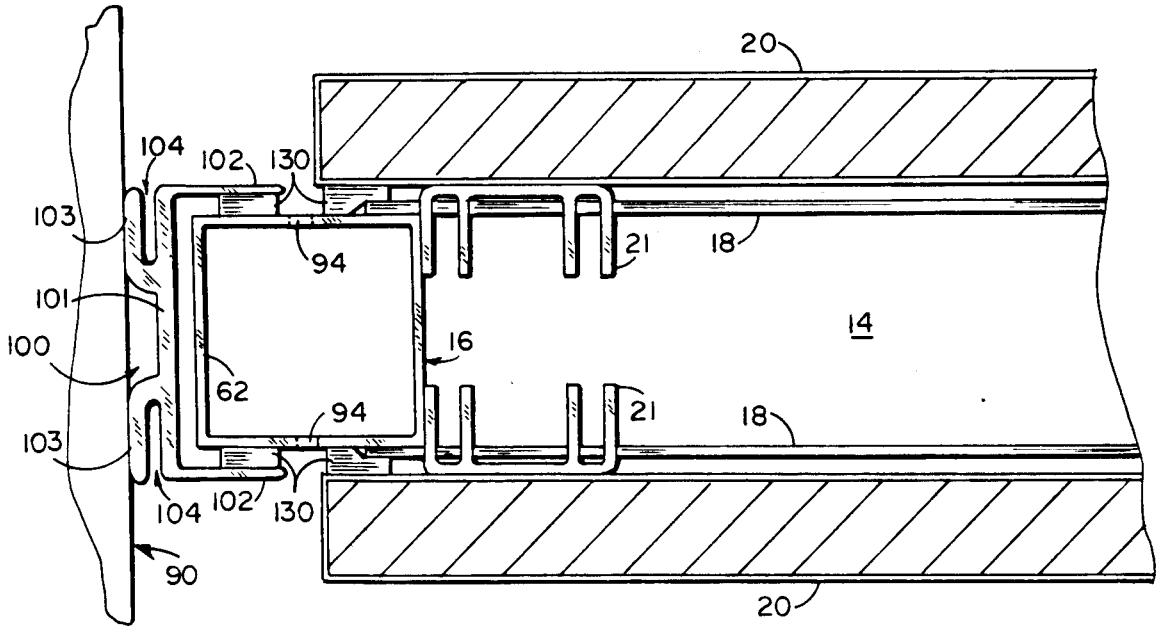
FIG. 11 is a top cross-sectional view of the wall system as shown in FIG. 10, but with the flexible covers removed from the rigid channel.

Panels 20 are suspended on stringers 18 by means of panel mounting hooks 21 (FIGS. 11 and 12). Panel mounting clips 21 are fastened to panels 20 and include hooks which hook over stringers 18.

Shown in FIG. 10 is an adapter assembly that accommodates variations in the vertical alignment of structural walls against which wall system 10 abuts, and accommodates gaps between standard wall lengths and the walls from which they project. This eliminates the need to piece in a small section of wall. A telescoping stud 16 is positioned closely adjacent a structural wall 90. A sidewardly opening, rectangular, U-shaped wall channel 100 is secured to structural wall 90 by suitable conventional fasteners. Wall channel 100 is made of a strong, rigid material, preferably extruded aluminum. It comprises a base wall 101 which is joined along its ends to integrally formed, spaced sidewalls 102. Wall channel 100 is sufficiently long that it extends generally the full length of at least the lower portion 62 of telescoping stud 16. Sidewalls 102 are spaced just sufficiently far apart that they receive vertical stud 16 with room for noise eliminating strips of foam tape 130 between sidewalls 102 and stud 16 (FIG. 11). They are sufficiently close together that they will fit between wall panels 20 when the alternative arrangement of FIG. 12 is used. Vertical stud 16 can be moved toward or away from fixed wall 90 within the confines of wall channel sidewalls 102 in order to facilitate the proper spacing from fixed wall 90.

Foam tape 130 is a conventional foam polymer tape, having an adhesive surface on one side, which is commercially available. A strip of foam tape 130 is adhered to vertical stud 16 on each side of the row of bracket receiving slots 94. Each strip of foam tape 130 extends at least from the bottom of lower portion 62 of stud 16 to the top thereof, and most preferably extends further upwardly to the top of the upper telescoping portion of vertical stud 16. These pieces of foam tape are then slightly compressed between a sidewall 102 of channel 100 and stud 16, and on the other side of slots 94, between wall panel 20 and stud 16. These strips of foam tape 130 help prevent "rattling" movement between the wall assembly and channel 100, and also help eliminate the passage of sound from one side of the wall assembly to the other, via any space around vertical stud 16.

Wall channel 100 also includes a pair of rear walls 103 which jut rearwardly from and then extend generally parallel to base wall 101. Back walls 103 extend in opposite directions from one another and are spaced from base wall 101 so as to define a pair of spaced slots 104 (FIG. 11) which open outwardly towards either side of wall channel 100. These slots facilitate the mounting of flexible covers 110 (FIG. 10).

Each flexible cover 110 preferably comprises a polymeric extrusion, e.g., polyvinyl chloride. It includes a foot 111 with a prong flange 112 projecting rearwardly therefrom. Prong flange 112 fits snugly into the slot defined by the space between wall channel back wall 103 and base wall 101. Foot 111 extends to either side of the slot opening to give flexible cover 110 a firm footing.

A short leg wall 113 extends from foot 111 in a direction opposite to that of prong flange 112. It is also somewhat thicker than prong flange 112 so that it is relatively stiff. An integrally formed cover flap 114 extends laterally from leg 113 for a distance substantially longer than the length of wall channel sidewall 102. In this way, cover flap 114 extends beyond the edge of a panel 20 suspended on vertical stud 16. Leg 113 is of such a length that cover flap 114 fits snugly against the surface of panel 20. In this way, a smooth, generally flush surface is presented to the eye of the viewer at the point at which the partition system abuts an existing wall 90.

Extending laterally away from leg 113 in a direction opposite to that of cover flap 114, so as to be generally continuous therewith, is a relatively short abutment shoulder 115. Abutment shoulder 115 abuts the surface of existing wall 90 so as to close any slight gap between the edge of leg 113 and wall 90 and so as to help ensure that cover flap 114 will be forced into engagement with the surface of panel 20.

Cover flap 114 is sufficiently thin and flexible that it can be deflected to allow access to the space behind cover flap 114. This will be desirable, for example, when one wants to mount brackets in mounting slots 94 in the lower portion 62 of vertical stud 16. Or if desired, a portion of cover flap 114 can be readily cut away with a knife or scissors to provide such accessibility.

Where spacing is such that a factory trimmed pair of wall panels 20 terminate in close proximity to a fixed wall 90 as illustrated in FIG. 11, it is not absolutely essential to use flexible cover members 110. The wall channel 100 and trimmed ends of wall panels 20 provide a sufficiently neat, trim appearance that flexible covers 110 can in some applications be dispensed with.

Figure 13:
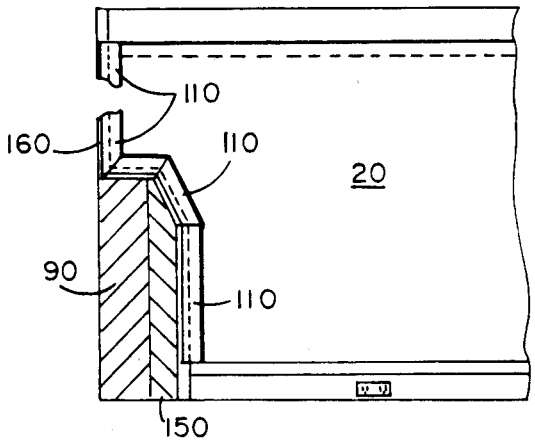
FIG. 13 is a side elevational view illustrating the type of condition one might encounter which would require using the alternative arrangement of members as illustrated in FIG. 12.

In some situations, however, it will be necessary to rough trim wall panels 20 in the field. FIG. 13 illustrates such a situation, where wall panels 20 have to be rough cut in order to fit over a short fixed wall 90, a radiator 150 and against a glass window 160, for example. In such an environment, flexible covers 110 serve to conceal the rough cut edges of wall panels 20.

Since no vertical stud 16 will be available to facilitate mounting the wall assembly within wall channel 100, wall panels 20 are cut sufficiently long that they fit over the sidewalls 102 of wall channel 100 (FIG. 12). Stringer 18 is fastened to vertical channel 100 with an angle chip, eliminating the need for a vertical stud 16 in cut panel situations. The spacing of channel sidewalls 102 is such that when wall panels 20 are hung over stringers 18 by means of clips 21, they snugly embrace the outside surfaces of sidewalls 102, and thereby assure a tight fit which eliminates rattling movement or the passage of noise from one side of the wall to the other. A small piece of foam tape 130 is placed between the inside of sidewall 102 and each stringer 18 so as to eliminate the possibility of relative movement therebetween. With wall panels 20 and wall channel 100 thus secured in place, flexible covers 110 can be inserted into slots 104 in the manner described above to provide a clean, trim appearance to the juncture between the rought cut end of the wall assembly and the adjacent fixed wall, or as illustrated in FIGS. 12 and 13, the adjacent radiator 150.

It is to be understood that the above is a description of the preferred embodiment and that one skilled in the art will recognize that various modifications or improvements may be made without departing from the spirit of the invention disclosed herein. The scope of protection afforded is to be determined by the claims which follow and the breadth of interpretation that the law allows.

The embodiments of the invention in which an exclusive property or privilege is claimed are defined as follows:

1. A floor-to-ceiling portion system comprising:

a partition for placement in proximity to an existing wall;

a rigid channel for mounting on an existing wall and including spaced rigid sidewalls engaging the opposite sides of said partition at the end thereof and a base wall joining said channel sidewalls;

a pair of flexible cover members, said rigid channel and said cover members including cooperating mounting means whereby one of said flexible cover members is mounted to cover each of the opposite sidewalls of said rigid channel;

said mounting means includes a slot at each side of said rigid channel being defined by a pair of back walls, jutting rearwardly from said base wall and then extending in a direction generally parallel to said base wall, and in opposite directions to one another, to thereby define at each side of said rigid channel a slot between each of said back walls and said base wall, and a prong flange on said flexible cover extending in one direction which is frictionally fitted into said slot; and each of said cover members including an elongated flexible cover flap, which is longer than each of said sidewalls of said rigid channel, whereby said flexible cover flap extends outwardly past the end of said partition and into engagement with a side of said partition to present to the viewer a generally flush, continuous appearance at the end of said partition in the vicinity of said pre-existing wall; said flexible cover flap having a resiliency which permits said cover flap to be resiliently pulled outward a significant amount so that access may be had to the covered end of said partition.

2. The partition system of claim 1 in which said partition comprises a generally vertical stud and a pair of exterior panels, one panel being located on each of two opposite sides of said stud and embracing a portion of said stud, but leaving a portion of said stud to project beyond said panels; said channel sidewalls being spaced at such a distance as to relatively closely embrace said projecting portion of said stud; said flexible cover comprising a leg extending in a direction generally opposite to that in which said prong flange extends, said cover flap extending laterally from the end of said leg.

3. The partition system of claim 2 in which there is a slight space between said channel sidewalls and said stud which is closed by a length of compressible, polymeric foam material.

4. The partition system of claim 3 in which there is a slight space between each of said exterior panels and said vertical stud which is closed by a length of compressible, polymeric foam material.

5. The partition system of claim 2 in which said flexible cover includes a foot at the juncture between said prong flange and said leg, said foot extending laterally to either side thereof and to either side of the opening of said slot in said rigid channel whereby said foot abuts the surfaces of said rigid channel which are adjacent either side of said slot, thereby providing a firm footing for said flexible cover.

6. The partition system of claim 5 in which a relatively short shoulder flange extends laterally from said leg,. in generally flush alignment with said cover flap, for a distance sufficient to close to appearance any gap between said leg and said permanent wall to which said rigid channel is secured.

7. The partition system of claim 1 in which said partition comprises a generally vertical stud and a pair of exterior panels, one panel being located on each of two opposite sides of said stud and embracing a portion of said stud, but leaving a portion of said stud to project beyond said panels; said channel sidewalls being spaced at such a distance as to closely embrace said projecting portion of said stud; said flexible cover comprising a leg extending in a direction generally opposite to that in which said prong flange extends, said cover flap extending laterally from the end of said leg.

8. The partition system of claim 7 in which said flexible cover includes a foot at the juncture between said prong flange and said leg, said foot extending laterally to either side thereof and to either side of the opening of said slot in said rigid channel whereby said foot abuts the surfaces of said rigid channel which are adjacent either side of said slot, thereby providing a firm footing for said flexible cover.

9. The partition system of claim 8 in which a relatively short shoulder flange extends laterally from said leg, in generally flush alignment with said cover flap, for a distance sufficient to close to appearance any gap between said leg and said permanent wall to which said rigid channel is secured.

10. The partition system of claim 9 in which said rigid channel is formed of extruded metal and said flexible cover is formed of extruded polymeric material.

11. The partition system of claim 7 in which said rigid channel is formed of extruded metal and said flexible cover is formed of extruded polymeric material.

12. The partition system of claim 2 in which said rigid channel is formed of extruded metal and said flexible cover is formed of extruded polymeric material.

13. The partition system of claim 1 in which said rigid channel is formed of extruded metal and said flexible cover is formed of extruded polymeric material.

14. The partition system of claim 1 in which said partition comprises a pair of spaced exterior panels, said panels being spaced at a distance such that they snugly embrace the external surfaces of said spaced rigid sidewalls of said rigid channel.

15. A floor-to-ceiling partition system comprising:

a partition for placement in proximity to an existing wall in which said partition comprises a generally vertical stud and a pair of exterior panels, one panel being located on each of two opposite sides of said stud and embracing a portion of said stud, but leaving a portion of said stud to project beyond said panels;

a rigid channel for mounting on an existing wall and including spaced rigid sidewalls, said channel sidewalls being spaced longitudinally from said exterior panels and spaced apart at such a distance as to relatively closely embrace said projecting portion of said stud;

a pair of flexible cover members, said rigid channel and said cover members including cooperating mounting means whereby one of said flexible cover members is mounted to cover each of the opposite sidewalls of said rigid channel; and each of said cover members including an elongated flexible cover flap, which is longer than each of said sidewalls of said rigid channel, such that said flexible cover flap extends outwardly past the stud of said partition and into engagement with one of said exterior panels of said partition to present to the viewer a generally flush, continuous appearance at the end of said partition in the vicinity of said pre-exiting wall.

16. The partition system of claim 15 in which said rigid channel includes a base wall joining said channel sidewalls, said slots at each side of said rigid channel being defined by a pair of back walls, jutting rearwardly from said base wall and then extending in a direction generally parallel to said base wall, and in opposite directions to one another, to thereby define at each side of said rigid channel a slot between each of said back walls and said base wall.

17. The partition system of claim 15 in which said rigid channel is formed of extruded metal and said flexible cover is formed of extruded polymeric material.

18. The partition system of claim 15 in which said cooperating mounting means on said rigid channel and each said flexible cover comprise a slot located at a base of each of said rigid channel sidewalls and opening laterally outwardly with respect to said rigid channel sidewalls, and a prong flange on said flexible cover extending in one direction which is frictionally fitted into said slot.

19. The partition system of claim 18 in which said flexible cover includes a leg extending in a direction generally opposite to that in which said prong flange extends and a foot at the juncture between said prong flange and said leg, said foot extending laterally to either side thereof and to either side of the opening of said slot in said rigid channel whereby said foot abuts the surfaces of said rigid channel which are adjacent either side of said slot, thereby providing a firm footing for said flexible cover.

20. The partition system of claim 19 in which a relatively short shoulder flange extends laterally from said leg, in generally flush alignment with said cover flap, for a distance sufficient to close to appearance any gap between said leg and said permanent wall to which said rigid channel is secured.

21. The partition system of claim 20 in which said rigid channel includes a base wall joining said channel sidewalls, said slots at each side of said rigid channel being defined by a pair of back walls, jutting rearwardly from said base wall and then extending in a direction generally parallel to said base wall, and in opposite directions to one another, to thereby define at each side of said rigid channel a slot between each of said back walls and said base wall.

22. The partition system of claim 21 in which said rigid channel is formed of extruded metal and said flexible cover is formed of extruded polymer material.

23. A floor-to-ceiling partition system comprising:

a partition for placement in proximity to an existing wall in which said partition comprises a generally vertical stud and a pair of exterior panels, one panel being located on each of two opposite sides of said stud and embracing a portion of said stud, but leaving a portion of said stud to project beyond said panels; and a rigid channel for mounting on an existing wall and including spaced rigid sidewalls embracing the opposite sides of said projecting portion of said stud and spaced longitudinally from the exterior panels there being a slight space between each of said rigid sidewalls and its adjacent stud surface, said space being filled by a length of compressible, polymeric material to eliminate rattling movement between said rigid channel and said stud and to minimize the passage of sound from one side of said partition to the other.

24. The partition system of claim 23 comprising:

a pair of flexible cover members, said rigid channel and said cover members including cooperating mounting means whereby one of said flexible cover members is mounted to cover each of the opposite sidewalls of said rigid channel; and said cooperating mounting means on said rigid channel and each said flexible cover comprise a slot located at a base of each of said rigid channel sidewalls and opening laterally outwardly with respect to said rigid channel sidewalls, and a prong flange on said flexible cover extending in one direction which is frictionally fitted to said slot.

25. The partition system of claim 24 in which said flexible cover includes a leg extending in a direction generally opposite to that in which said prong flange extends and a foot at the juncture between said prong flange and said leg, said foot extending laterally to either side thereof and to either side of the opening of said slot in said rigid channel whereby said foot abuts the surfaces of said rigid channel which are adjacent either side of said slot, thereby providing a firm footing for said flexible cover.

26. The partition system of claim 24 in which each of said cover members include an elongated flexible cover flap, which is longer than each of said sidewalls of said rigid channel, such that said flexible cover flap extends outwardly past the stud of said partition and into engagement with one of said exterior panels of said partition to present to the viewer a generally flush, continuous appearance at the end of said partition in the vicinity of said pre-existing wall.

27. The partition system of claim 23 in which there is a slight space between each of the exterior panels and said vertical stud, said space being filled by a length of compressible, polymeric material.

* * * * *